US007240379B2

(12) United States Patent
Switzer

(10) Patent No.: US 7,240,379 B2
(45) Date of Patent: Jul. 10, 2007

(54) PORTABLE SINK FOR HAND-DIPPED ICE CREAM, GELATO, FROZEN YOGURT, AND FROZEN CUSTARD CATERING AND VENDING

(76) Inventor: Michael Anthony Switzer, 9 Valhalla Cir., Columbia, SC (US) 29229

( * ) Notice: Subject to any disclaimer, the term of this patent is extended or adjusted under 35 U.S.C. 154(b) by 0 days.

(21) Appl. No.: 11/294,228

(22) Filed: Dec. 5, 2005

(65) Prior Publication Data

US 2006/0102431 A1 May 18, 2006

Related U.S. Application Data

(63) Continuation-in-part of application No. 10/741,541, filed on Dec. 22, 2003, now abandoned.

(51) Int. Cl.
*A47K 1/00* (2006.01)

(52) U.S. Cl. ..... 4/625; 4/626; 4/627; 4/630

(58) Field of Classification Search ..... 4/514, 4/516, 619, 624–627, 630; 312/236, 237, 312/330.1, 350; 186/27, 33, 40, 45
See application file for complete search history.

(56) References Cited

U.S. PATENT DOCUMENTS 3,724,921 A * 4/1973 Lake ..... 312/237
3,983,583 A * 10/1976 Herman et al. ..... 4/626
5,465,438 A * 11/1995 Allman et al. ..... 4/626
5,862,540 A * 1/1999 Chuan ..... 4/449
6,173,458 B1 * 1/2001 Maddux ..... 4/626

* cited by examiner

*Primary Examiner*—Tuan Nguyen
(74) *Attorney, Agent, or Firm*—J. Bennett Mullinax, LLC

(57) ABSTRACT

A portable sink having a hot and cold water faucet connected to an electric water pump and fresh water tank and a wastewater outlet from said sink connected to a wastewater tank and cabinet mounted on wheels having one upper door that has a dipwell attached that is connected to the fresh and waste-water systems and one lower door to access the interior thereof. The dipwell is mounted on the upper door that is rotatable about a vertical access. The dipwell is within the cabinet when the door is closed and outside the cabinet when the door is rotated 90 degrees in a locked open position. One tank for fresh water is mounted in the cabinet and a tank for wastewater is mounted outside the cabinet. There is an electrical connection for powering the water pump and water heater.

1 Claim, 3 Drawing Sheets

PORTABLE SINK FOR HAND-DIPPED ICE CREAM, GELATO, FROZEN YOGURT, AND FROZEN CUSTARD CATERING AND VENDING

CROSS REFERENCE TO RELATED APPLICATION

This application is a continuation-in-part application of prior application Ser. No. Ser. No. 10/741,541, filed Dec. 22, 2003, which is now abandoned.

BACKGROUND OF INVENTION

1. Field of the Invention

The field of this invention resides within the field of hand-dipped ice cream catering and vending. To this extent it involves the washing of the hands and a running dipwell in order to maintain a degree of cleanliness in the dispensing of hand-dipped ice cream, gelato, frozen yogurt, and frozen custard.

2. Prior Art

As part of the inventor's research, it was discovered that most hand-dipped ice cream, gelato, frozen yogurt, and frozen custard catering and/or vending operations do not utilize the appropriate equipment required by local health departments. Most health department requirements are that the cart used for hand-dipped ice cream, gelato, frozen yogurt, and frozen custard must have a dipwell with running water, a fresh water source, a waste-water tank with at least twice the capacity of the fresh water source, and a hand sink with hot and cold running water. It was also discovered that although there are portable sinks available that could be used to satisfy said hand-washing requirements, there were none to be found that also included a running dipwell for ice cream, gelato, frozen yogurt, and frozen custard scoops. There were also none to be found that included a wastewater tank at least twice the size of the fresh water tank. There were also none to be found that included a wastewater tank with its own set of wheels that was attached to the outside of the cabinet, making for ease of dumping.

This invention solves these problems by providing a portable sink with attached dipwell and a large wastewater tank with its own set of wheels mounted outside the cabinet for cleanliness and health. The sink specifically has a fresh water source and a reservoir for the wastewater. The sink has a faucet with hot and cold running water, the hot water being provided through a water-heater. It also has a foldout door with a dipwell attached that is connected to the water pump and drain systems. Additionally thereto, an electrical outlet provides for heating and pumping of the water on a continuum. The hose attached to the fresh water tank also has a standard garden hose connection with a filter so that it can be connected directly to an outside spigot and therefore making it unnecessary to turn on the electric water pump.

The entire unit is a portable unit with wheels attached, including a separate set of wheels for the wastewater tank. The countertop on the sink cabinet is made of restaurant-quality stainless steel. The wastewater tank is comprised of modular plastic. The entire unit has ease of handling, operation, and maintenance.

BRIEF SUMMARY OF THE INVENTION

In summation, this invention comprises a portable sink with hot and cold running water and an attached dipwell on a foldout door. The sink has a fresh water supply, a water-heater, an electric water pump, a faucet for allowing the flow of hot and cold water into a sink, a valve and spout for allowing the flow of cold water into the dipwell and a waste-water tank to hold the used water.

More specifically, the invention comprises a portable sink built into a cabinet that is mounted on wheels and houses one tank of fresh water, with plumbing that hooks the drain line to a separate wastewater tank, also on wheels, connected to the outside of the cabinet.

In order to heat the water, an electrical inlet provides heat through a switch outlet box to a water-heater having heater coils and controls. The heater is supplied by water from the fresh water tanks through an electric pump. In order to provide for safety, a bypass valve or blow tube is installed on the water heater that compensates for over pressure.

The pump also provides cold water to the faucet outside of the circuit of the water heater for an appropriate mixture of hot and cold water through the faucet.

The water heater and controls including the switch outlet and pump are mounted inside the stainless steel cabinet and can be easily removed for servicing. Further to this extent, the fresh water tank and wastewater tank can also be easily removed for servicing from their respective positions.

Although other portable sinks similar to this one can be found, this invention is the only known sink with a built-in dipwell, and fresh water and wastewater tanks with the specific dimensions for the hand-dipped ice cream, gelato, frozen yogurt, and frozen custard catering and vending industry.

DETAILED DESCRIPTION OF THE INVENTION

Figure 1:
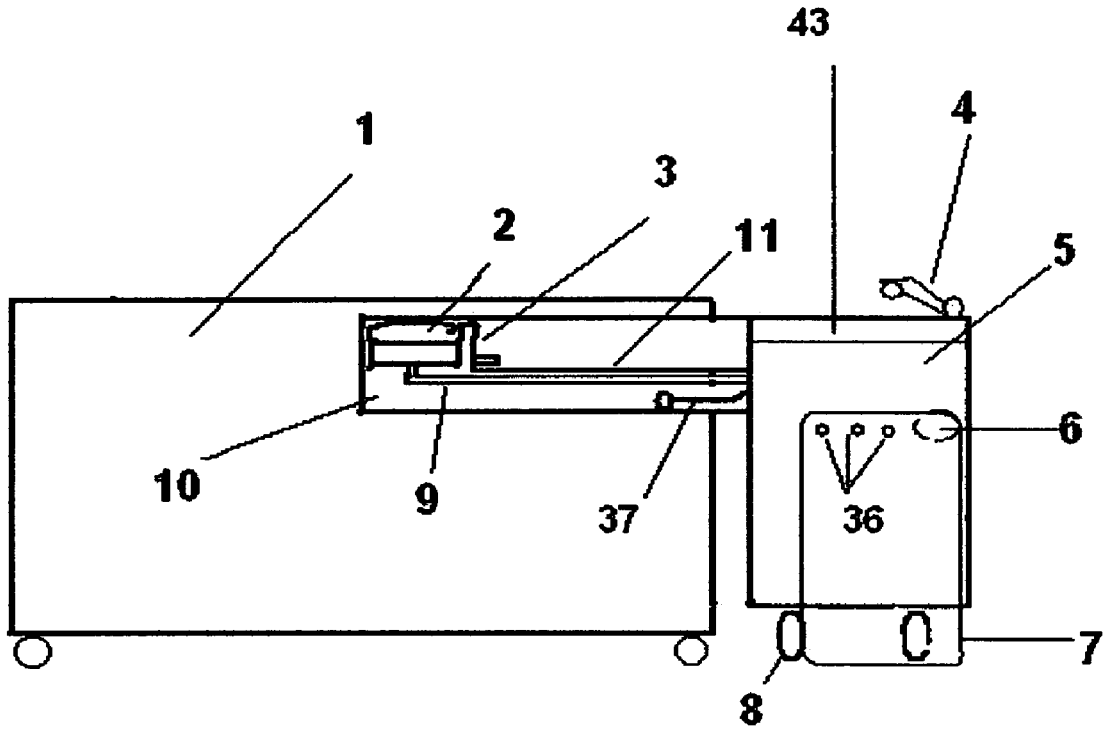
FIG. 1 shows a side view of the sink cabinet and attached wastewater tank of this invention with the upper door holding the dipwell opened against the back of a freezer.
Figure 4:
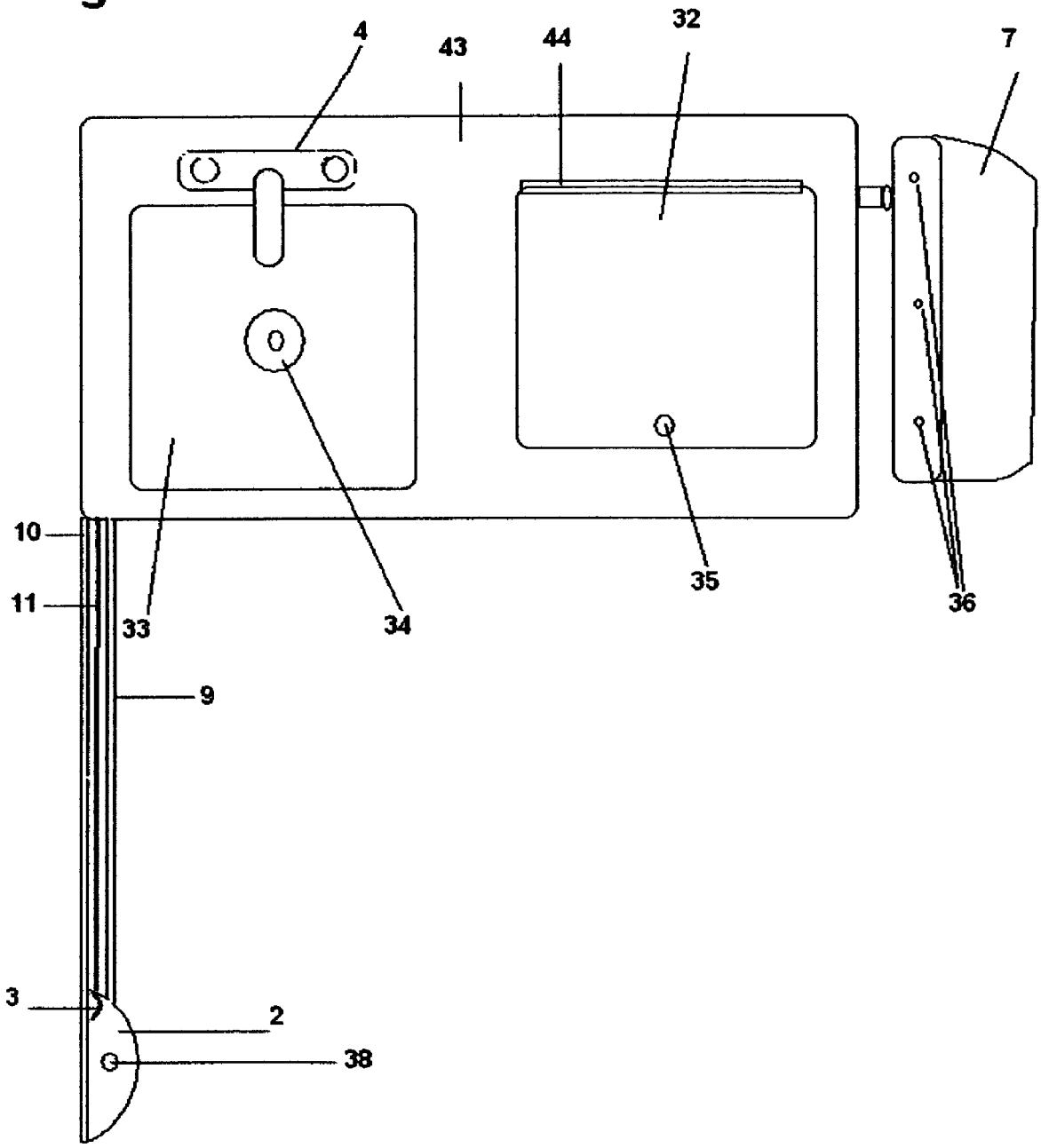
FIG. 4 shows an aerial view of the sink cabinet with the upper dipwell door open and the connected wastewater tank, and specifically the location of the sink basin and the storage bin.

Looking specifically at FIG. 1 it can be seen that a cabinet 5 has been shown with a sink faucet 4 and a dipwell 2. The upper section 43 is a stainless steel counter top that houses the sink basin 33 and storage bin 32, which are shown in FIG. 4. FIG. 1 shows the cabinet 5 with the upper door 10 that has the dipwell 2 attached and positioned so that the door 10 is against the back of a freezer 1, which is its intended use. The dipwell is connected to the plumbing system via a ¼" fresh water line 11 and a ¼" ball valve 3 and a ½" drain hose 9. The upper door 10 locks in place at a 90 degree angle when open by placing moveable latch arm 37 over bolt on inside of cabinet. The latch arm 37 can then be raised when door 10 is ready to be closed. The wastewater tank 7 is shown connected to the side of sink cabinet 5 via a standard garden hose connection 6. The drain hose from the sink is inserted through a 3" oval hole in the side of cabinet 5 and screwed onto a threaded plastic post that is part of wastewater tank 7. FIG. 1 also shows the three ⅜" air holes located at the top of the wastewater tank. The holes are necessary to allow air to escape the tank while wastewater is being drained into it.

Figure 2:
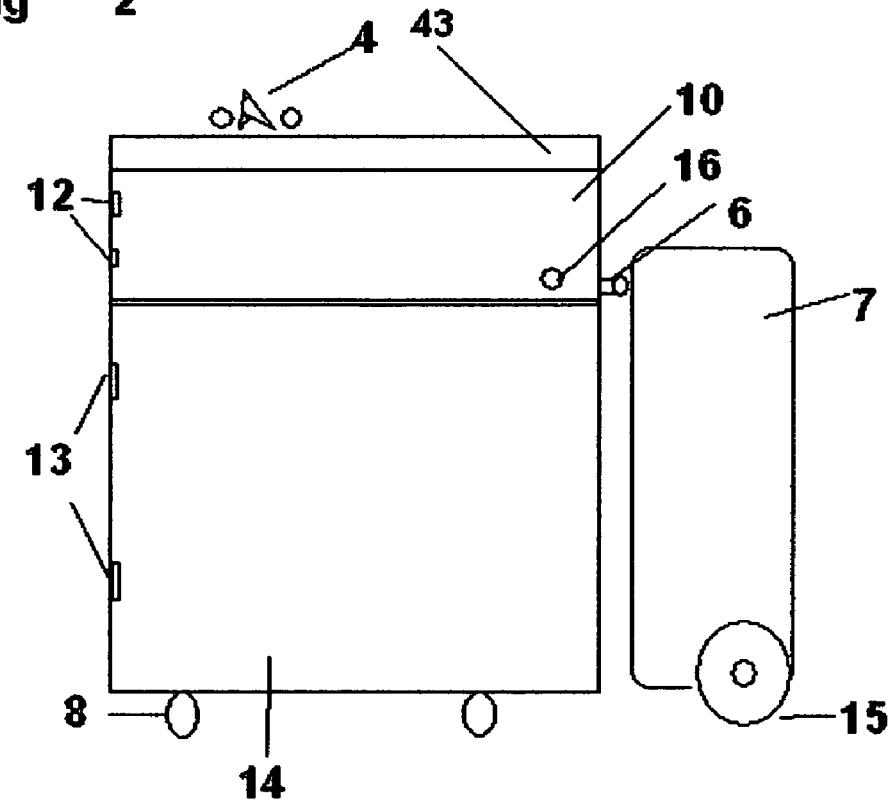
FIG. 2 shows a front view of the sink cabinet and attached wastewater tank with the doors closed.

FIG. 2 shows the cabinet's two doors 10 and 14 in their closed positions. The two respective doors 10 and 14 are supported on hinge points that can be seen in the way of hinge elements 12 and 13. A finger hole 16 is cut into the door 10 to allow easy access by merely inserting one's finger and pulling the door. The lower door 14 can simply be opened and closed by pulling or pushing it. FIG. 2 also shows a side view of how wastewater yank 7 is connected to cabinet 5 via standard garden hose connection 6. It also shows one of the two 8" stationary wheels that are located on the bottom of each side of wastewater tank 7. The cabinet 5 is supported by four swivel wheels or casters 8, two of which have brake elements that can be pressed downwardly to prevent the wheels from turning. The wheels or casters can be of any configuration but are shown welded to the bottom of cabinet 5.

Figure 3:
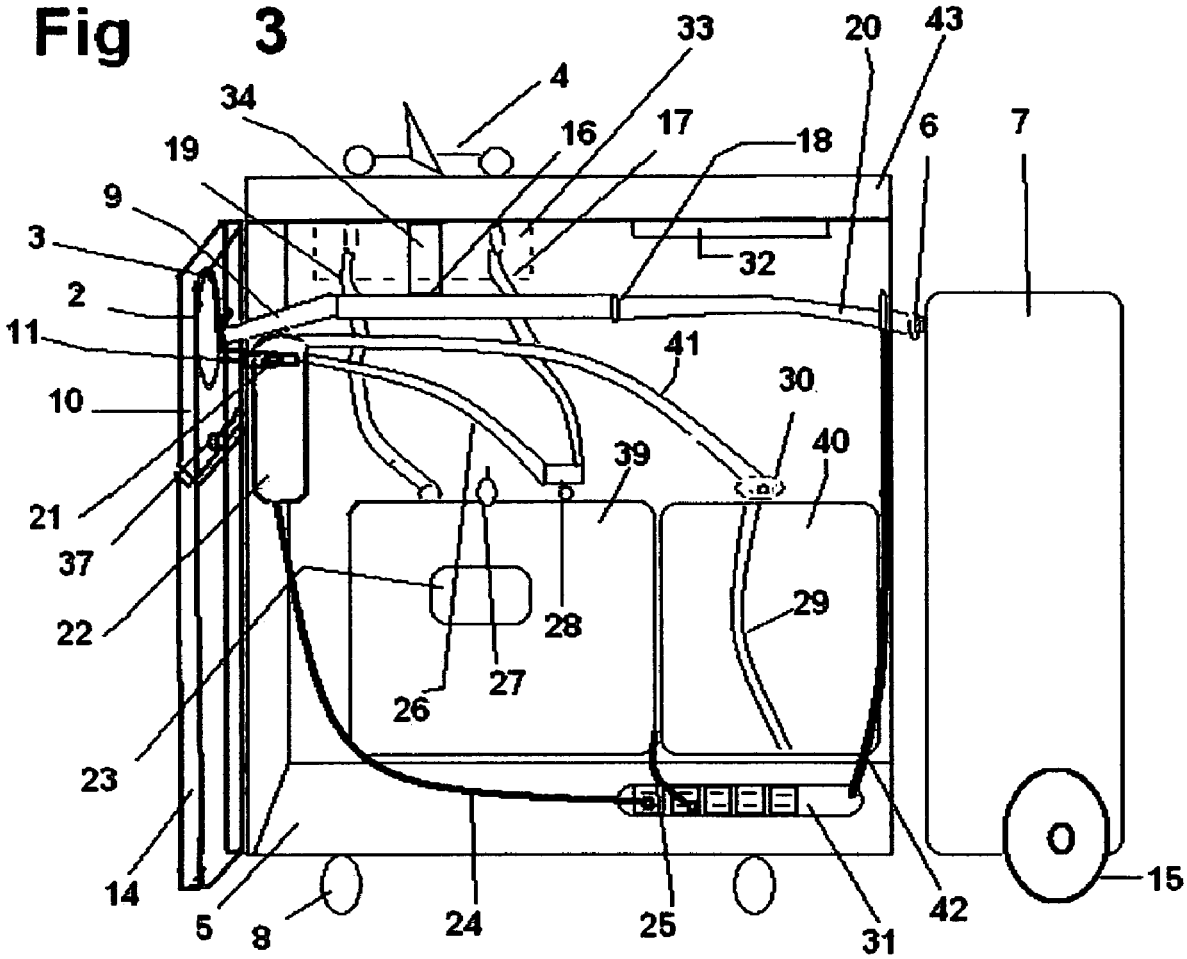
FIG. 3 shows a front view of the sink cabinet and wastewater tank with both doors open detailing the interior area, specifically the plumbing and electrical connections.

FIG. 3 shows the invention with both doors 10 and 14 open. The drain system is shown by a standard garden hose section 9 and PVC pipe 16 connected to the dipwell 2 and the sink drain 34 respectively. A standard garden hose section 20 then connects the drain system to the separate wastewater tank 7 at connections 18 and 6. The fresh water is brought from the fresh water tank 40 via an intake hose 29 inside the tank, which is connected, to the fresh water tank cap 30. Another intake hose 41 brings the fresh water from the cap 30 to the electric water pump 22. Intake hose 41 is connected to the cap 30 via a standard garden hose connection with an inserted screen. (The screen keeps debris from entering the fresh water system and the garden hose connection allows the fresh water system to be hooked up to a standard outdoor faucet, eliminating the need for the fresh water tank 40 or the pump 22 to be turned on.) The water pump 22 then distributes the fresh water via a tee 21 connected to the pump 22. Fresh water hose 11 delivers the water from the tee 21 to the dipwell valve 3, while fresh water hose 26 delivers the water from tee 21 to tee 28 which is connected to the cold water port of water heater 39. Fresh water hose 17 then delivers cold water from tee 28 to the cold water connection of faucet 4. Fresh water hose 19 delivers the water from the hot water port on water heater 39 to the hot water connection of faucet 4. The water heater off/on switch and temperature control are located at control panel 23. The pump 22 and water heater 39 are plugged into multi-outlet electrical strip 31 via electrical cords 24 and 25, respectively. Strip 31 is connected to an outside electrical outlet via electrical cord 42 which is fed through the oval hole (which has a rubber grommet) near the top of the cabinet 5 where the wastewater tank 7 is connected.

FIG. 4 shows an aerial view of the invention with upper door 10 in the open and locked position. Stainless steel counter top 43 houses the sink basin 33, faucet 4, and the storage basin 32. Storage basin 32's lid is attached via hinge 44 and has a finger hole 35 for raising and lowering the lid. Inserted into the center of the drain of dipwell 2 is a brass tube 38 which allows the dipwell to hold water and for overflow of the fresh water into the drain below so that dipwell will not overflow.

From the foregoing, it can be seen that this invention is a substantial step over the art of providing for a portable sink to be used by the hand-dipped ice cream, gelato, yogurt, and frozen custard catering and vending industry.

What is claimed is:

1. A portable sink to accompany ice cream, gelato, frozen yogurt, and frozen custard catering and/or vending comprising: a cabinet with a stainless steel counter top that houses a built-in sink with a water faucet, a storage bin; an electrical connection for connection to an external source of power; a water pump for attachment to said electrical connection; a fresh water tank; a wastewater tank with its own set of wheels that is connected to the outside of the cabinet and is twice the capacity of the fresh water tank; connection conduits between said pump, said fresh water source, and said wastewater tank; a connection conduit between said pump and said faucet for delivering fresh water to said faucet when said pump is turned on and is capable of connecting to an existing pressurized water supply for delivering fresh water to said faucet when pump is not turned on; conduit means from said sink to said wastewater reservoir; a dipwell attached to a fold-out door on the sink cabinet: the dipwell being attached to an in-take conduit and an out-take conduit by way of a shut-off valve, a spout, and a drain, the dipwell is mounted on an upper door that is rotatable about a vertical axis; the dipwell is contained within the cabinet when the door is in closed position and is located outside the cabinet when the door is rotated 90 degrees in a locked open position; wheels mounted to said cabinet for movement of said sink and cabinet; an electrical water heater for providing hot water between said pump and said faucet.

* * * * *